US010634109B2

(12) United States Patent
Tang

(10) Patent No.: US 10,634,109 B2
(45) Date of Patent: Apr. 28, 2020

(54) MULTIPLE PULSE IGNITION SYSTEM CONTROL

(71) Applicant: FAIRCHILD SEMICONDUCTOR CORPORATION, Sunnyvale, CA (US)

(72) Inventor: Qingquan Tang, Breinigsville, PA (US)

(73) Assignee: Fairchild Semiconductor Corporation, Phoenix, AZ (US)

( * ) Notice: Subject to any disclaimer, the term of this patent is extended or adjusted under 35 U.S.C. 154(b) by 438 days.

(21) Appl. No.: 15/674,017

(22) Filed: Aug. 10, 2017

(65) Prior Publication Data

US 2018/0058414 A1 Mar. 1, 2018

Related U.S. Application Data

(60) Provisional application No. 62/380,152, filed on Aug. 26, 2016.

(51) Int. Cl.

| | |
|---|---|
| ***F02P 3/05*** | (2006.01) |
| ***F02P 3/055*** | (2006.01) |
| ***F02P 3/04*** | (2006.01) |
| ***F02P 3/045*** | (2006.01) |
| ***H01F 38/12*** | (2006.01) |
| *F02P 5/15* | (2006.01) |

(52) U.S. Cl.
CPC ..... *F02P 3/055* (2013.01); *F02P 3/045* (2013.01); *F02P 3/0407* (2013.01); *F02P 3/053* (2013.01); *H01F 38/12* (2013.01); *F02P 5/1502* (2013.01)

(58) Field of Classification Search
CPC .. F02P 3/055; F02P 3/053; F02P 3/045; F02P 3/0407; F02P 5/1502; F02P 9/00; H01F 38/12
See application file for complete search history.

(56) References Cited

U.S. PATENT DOCUMENTS 6,450,157 B1 9/2002 Kesler et al.
7,080,639 B1 7/2006 Pattantyus

*Primary Examiner* — Xiao En Mo
(74) *Attorney, Agent, or Firm* — Brake Hughes Bellermann LLP

(57) ABSTRACT

In a general aspect, an ignition circuit can include a control circuit that is coupled with an engine control unit (ECU) to receive a command signal from the ECU. The control circuit can include a multi-pulse generator configured to, in response to the command signal, generate a multi-pulse drive signal. The multi-pulse drive signal can include a first pulse cycle having a first duty cycle, a second pulse cycle having a second duty cycle, and a dwell period during which the multi-pulse drive signal continuously remains at a logic high value. The control circuit can be configured to provide the multi-pulse drive signal to an ignition switch coupled with the control circuit to receive the multi-pulse drive signal.

20 Claims, 11 Drawing Sheets

MULTIPLE PULSE IGNITION SYSTEM CONTROL

CROSS-REFERENCE TO RELATED APPLICATION

This application claims priority to and the benefit of U.S. Provisional Application No. 62/380,152, filed Aug. 26, 2016, entitled "MULTIPLE PULSE IGNITION SYSTEM CONTROL", which is hereby incorporated by reference in its entirety.

TECHNICAL FIELD

This disclosure relates to ignitions systems, such as ignition systems for use in a motor vehicle engine. More particularly, this disclosure relates to ignition systems, and control of such ignition systems, that prevent voltage transients (e.g., voltage spikes) that can cause improper sparking of a spark plug in an ignition system, allow for larger tolerance to signal variations and/or reduce sensitivity of operation to variations in temperature.

BACKGROUND

Ignition system control is an important part of modern ignition coil devices and systems, such as may be used in automobiles and other vehicles that include an internal combustion engine. Without proper ignition system control, spark plugs may spark at improper times resulting in pre-ignition (which can also be referred to as engine knocking). Repeated occurrences of pre-ignition or engine knocking can cause engine parts to be damaged or destroyed.

Different approaches have been used to suppress the voltages spike, such as "turn-on" voltage spikes of an ignition insulated-gate bipolar transistor (IGBT) that can cause either undesired sparking. For instance, in some current implementations, a high-voltage (HV) diode can be used to suppress such voltages spikes. However, including such a HV diode adds undesirable extra cost (e.g., cost of manufacture) to the associated ignition control circuit.

In other implementations, an extra control circuitry can be added to suppress such voltage spikes. However, such control circuitry may be undesirable in many implementations.

SUMMARY

In a general aspect, an ignition circuit can include a control circuit that is coupled with an engine control unit (ECU) to receive a command signal from the ECU. The control circuit can include a multi-pulse generator configured to, in response to the command signal, generate a multi-pulse drive signal. The multi-pulse drive signal can include a first pulse cycle having a first duty cycle, a second pulse cycle having a second duty cycle, and a dwell period during which the multi-pulse drive signal continuously remains at a logic high value. The control circuit can be configured to provide the multi-pulse drive signal to an ignition switch coupled with the control circuit to receive the multi-pulse drive signal.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1A:
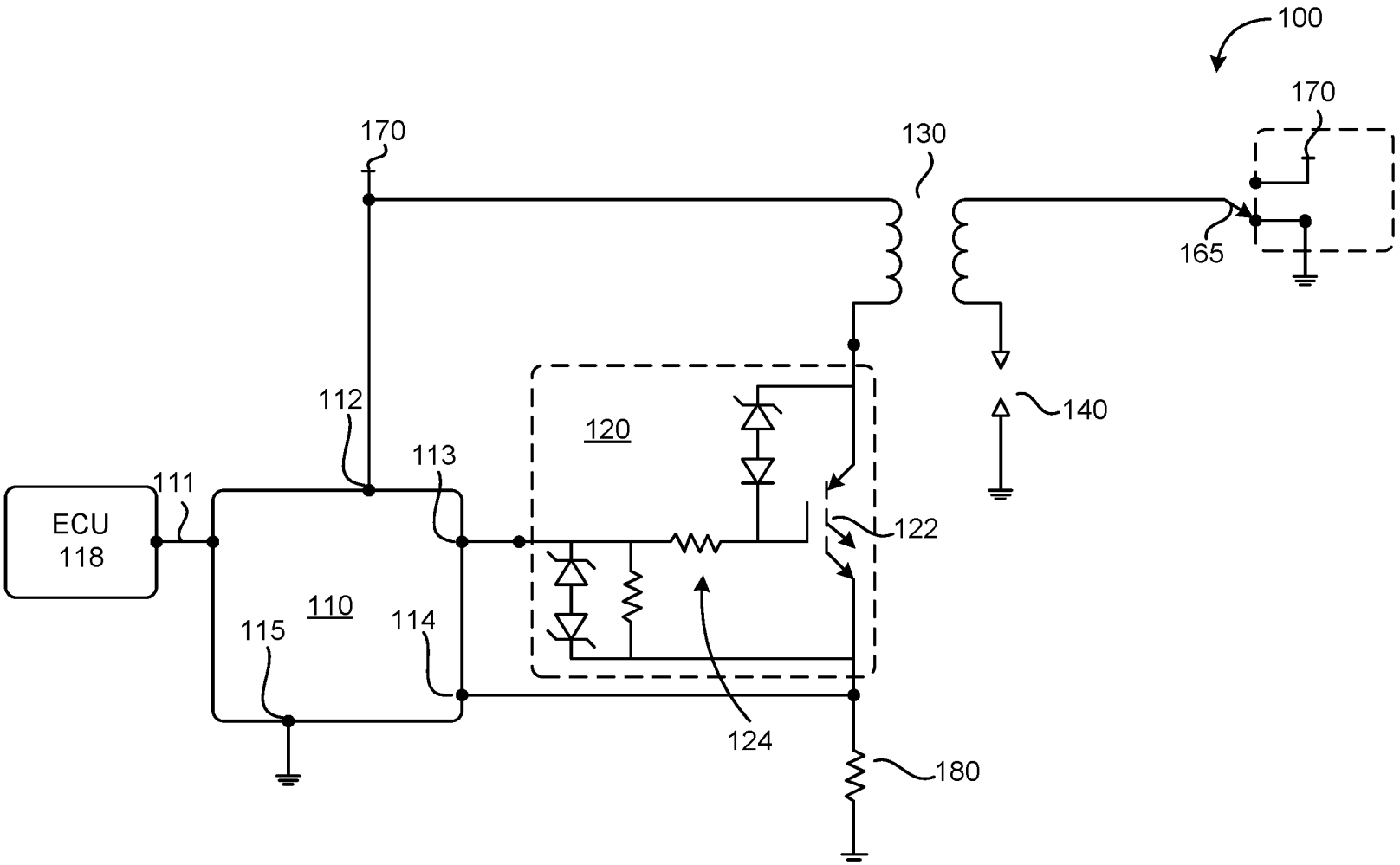
FIG. 1A is a schematic/block diagram that illustrates an ignition circuit.

Ignition system control is an important part of modern ignition coil devices and systems. Without proper ignition system control, spark plugs may spark at improper times resulting in pre-ignition or engine knocking, as noted above. FIG. 1A is a schematic/block diagram that illustrates an example implementation of an ignition control circuit (ignition circuit or circuit) 100 that can prevent such pre-ignition. For example, the ignition circuit 100 can be configured to provide a multi-pulse drive signal for controlling charging of an ignition coil and generating a spark in a spark plug of the ignition circuit. For instance, such a multi-pulse drive signal can include a plurality of pulses (e.g., two or more pulses) that is followed by a dwell time (e.g., where the drive signal remains at a constant logic level). Examples of multi-pulse drive signals are described in further detail below in connection with the various drawings.

As shown in FIG. 1A, the ignition circuit 100 includes a control integrated (IC) 110 and an ignition (insulated-gate bipolar transistor (IGBT)) 120. In some implementations, the ignition IGBT 120 could be implemented using another type of ignition switch, such as a high voltage metal-oxide-semiconductor (MOS) transistor. In the example of FIG. 1A, the ignition IGBT 120 can include an IGBT device 122 and a resistor-diode network (network) 124. The network 124 can be configured to define a high-voltage clamp for the ignition circuit 100, as well as limit current applied to a gate terminal of the IGBT device 122. As shown in FIG. 1A, the ignition circuit 100 can also include an ignition coil 130 (e.g., a magnetic-core transformer) and a spark plug 140.

The ignition circuit 100 of FIG. 1A also includes a resistor 180 (which can be referred to as a sense resistor or $R_{sense}$), which can be used, based on a time varying voltage across the resistor 180, to determine a primary current in a primary winding of the ignition coil 130. The resistor 180 can also be used to detect changes in a slope of the primary current, e.g., to detect improper function and/or failures in the ignition control circuit 100, where the control circuit 110 can be configured to take one or more actions to mitigate the effects of such failures.

As shown in FIG. 1A, the control IC (control circuit) 110 can include a plurality of terminals. For instance, in the circuit 100, the control IC 110 includes terminals 111, 112, 113 114 and 115. These terminals can each be a single terminal or can include respective multiple terminals, depending on the particular implementation and/or the particular terminal. For instance, in the control IC 110, the terminal 111 can include multiple terminals that are coupled with an engine control unit (ECU) 118 to receive and/or send signals to the ECU 118. For instance, the ECU 118 may communicate a command signal (or signals) to the control IC 110 via the terminal 111 (e.g., on a first terminal of the multiple terminals of terminal 111) that is (are) used to generate a drive signal, such as multi-pulse drive signals as described herein. In some implementations, such multi-pulse drive signals can control charging of the ignition coil 130 and firing of the spark plug 140 (e.g. by using energy stored in the ignition coil 130 during such charging) while preventing voltage spikes resulting in pre-ignition, increasing tolerance to variations in signal timing and/or reducing sensitivity to operating temperature of the ignition control circuit 100.

As noted above, a multi-pulse drive signal can include multiple pulses (e.g., two or more pulses, such as two pulses, three pulses, four pulses, five pulses, etc.), where each successive pulse can have a wider pulse width (larger duty cycle) than its previous pulse. In some implementations, the pulse cycle time (period) for each pulse of a multi-pulse drive signal can be equal (substantially equal). The multiple pulses can be used, at the beginning of an ignition cycle, to begin storing energy in an associated ignition coil (e.g., the ignition coil 130) for initiating a spark in a spark plug (e.g., the spark plug 140) and combusting a fuel mixture in a cylinder of an engine.

As an example of a multi-pulse drive signal, a first pulse of the multi-pulse drive signal could have a first duty cycle of 50% and a pulse cycle time of 10 μs (for a pulse width of 5 μs). A second pulse of the multi-pulse signal could have a duty cycle of 60% and a pulse cycle time of 10 μs (for a pulse width of 6 μs). A third pulse of the multi-pulse signal could have a duty cycle of 70% and a pulse cycle time of 10 μs (for a pulse width of 7 μs). A fourth pulse of the multi-pulse signal could have a duty cycle of 80% and a pulse cycle time of 10 μs (for a pulse width of 8 μs). A fifth pulse of the multi-pulse signal could have a duty cycle of 90% and a pulse cycle time of 10 μs (for a pulse width of 9 μs). In some implementations, a multi-pulse signal can include fewer pulses, more pulses, have different pulse widths and/or the pulses can have a different pulse cycle time (period). After the multiple pulses are provided, a multi-pulse drive signal can include a dwell time signal, where the multi-pulse drive signal is held at a single logic level (e.g., logic high) to allow for continued storage of energy in the associated ignition coil for spark generation and fuel combustion for a given ignition cycle of the ignition circuit 100.

In the circuit 100 of FIG. 1A (e.g., using the control circuit 110 shown in FIG. 1B), in response to receiving such a multi-pulse drive signal, the IGBT device 124 of the ignition IGBT 122 may regulate current flow (in correspondence with the multi-pulse drive signal) through a first side (the primary winding) of the ignition coil 130. The ignition coil 130 may transform a voltage on the first side of the ignition coil 130 to a higher voltage on a second side (secondary winding) of the ignition coil (based on a ratio of a number of turns in the secondary to a number of turns in the primary winding) without causing voltage spikes that can result in undesired sparking of the spark plug 140 (pre-ignition or engine knocking). For instance, as the transformation (or amplification) of the voltage by the ignition coil 130 (from the primary winding to the second winding) can also amplify voltage variations(voltage spikes) as well, voltage spike on the primary winding can be amplified and produce such undesirable peak voltages, or voltage spikes, on the secondary winding (and cause pre-ignition). Using multi-pulse drive signals, such as described herein, such voltage spikes can be prevented (or reduced) and, as a result, can prevent such undesired sparking from occurring.

As is described in further detail below, in response to the command signal turning off, the control circuit 110 may turn off the drive signal (e.g., after a dwell time which sufficiently charges to ignition coil 130 to produce a spark in the spark plug 140 and combust a fuel mixture in an associated engine cylinder). For example, after a dwell time, turning off the drive signal causes the IGBT device 122 to turn off and, as a result, causes current flow through the primary winding of the ignition coil 130 to cease. When current flow through the primary winding of the ignition coil 130 (and through the IGBT device 122) ceases, energy stored in the primary winding of the ignition coil 130 can be transferred to the secondary winding of the ignition coil 130 (through magnetic induction), and this transferred energy (and amplified voltage on the secondary winding) may be used to generate a spark in the spark plug 140 and combust the fuel mixture.

In at least one implementation, a second terminal of the multiple terminals of terminal 111 can be used to communicate one or more signals, from the circuit 100 to the ECU 118, that indicate occurrence of a failure mode, and/or to indicate that the circuit 100 is operating normally, or as expected. In other implementations, the terminal 111 could be a single bi-directional terminal configured to both send and receive such signals, e.g., signals for controlling an ignition sequence and signals indicating operating conditions of the ignition circuit 100.

In FIG. 1A, the terminal 112 of the control IC 110 can be a power supply terminal that receives a battery voltage ($V_{bat}$) 170, such as from a battery of a vehicle in which the ignition circuit 100 is implemented. In the control circuit 110, the terminal 113 may be used to provide a multi-pulse drive signal that is generated in response to the command signal from the ECU 118. The multi-pulse drive signal can then control a gate of the IGBT device 122 (e.g. to control charging of the ignition coil 130 and firing of the spark plug 140).

As shown in FIG. 1A, a switch 165 can be used to switch between the battery voltage 170 and electrical ground. The terminal 114 of the control IC 110 can be configured to receive a voltage signal, e.g., a time varying voltage across the $R_{sense}$ resistor 180 over each ignition cycle, which can be referred to as a $V_{sense}$ signal. The $V_{sense}$ signal received at terminal 114 can be used by the control circuit 110 for detection of a current through the primary winding of the ignition coil 130. Further in FIG. 1A, the terminal 115 of the control IC 110 can be a ground terminal that is connected with an electrical ground for the circuit 100.

Figure 1B:
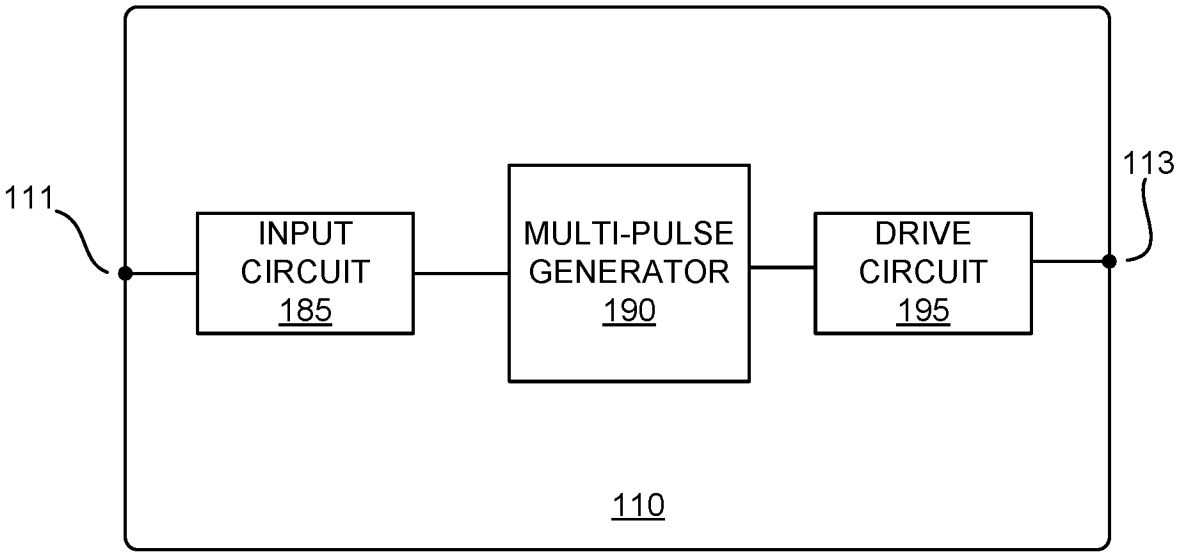
FIG. 1B is a block diagram that illustrates a control circuit that can be implemented in the ignition circuit of FIG. 1A.

FIG. 1B is a block diagram that illustrates an example implementation of a control circuit 110 that can be implemented in the ignition circuit 100 of FIG. 1A. The control circuit 110 of FIG. 1B is given by way of example and control circuits having other configurations are possible. For purposes of illustration, the control circuit 110 in FIG. 1B is described with further reference to FIG. 1A.

As shown in FIG. 1B, the control circuit 110 can include an input circuit 185, a multi-pulse generator 190 and a drive circuit 195. The input circuit 185 can be coupled with the terminal 111 to receive a command signal from the ECU 118 of the ignition circuit 100. The input circuit 185 can be coupled with the multi-pulse generator 190, and can provide a version of the command signal (e.g., a filtered and/or delayed version of the command signal) to the multi-pulse generator 190. As also shown in FIG. 1B, the multi-pulse generator 190 can coupled with the drive circuit 195. The multi-pulse generator 190 can be configured to, in response to the version of the command signal received from the input circuit 185, generate a multi-pulse drive signal that is provide to the drive circuit 195. The drive circuit 195 can be configured to provide, via the terminal 113, the multi-pulse drive signal (such as the multi-pulse drive signals described herein) to the ignition IGBT 120. For instance, the multi-pulse generator 190 can include a timing control circuit that is configured to control a number of pulses, the timing (pulse cycle time) of the pulses, the duty cycles (pulse widths) of the pulses and/or a dwell time of the multi-pulse drive signal. In some implementations, the drive circuit 195 can be incorporated in the multi-pulse generator 190.

Figure 2:
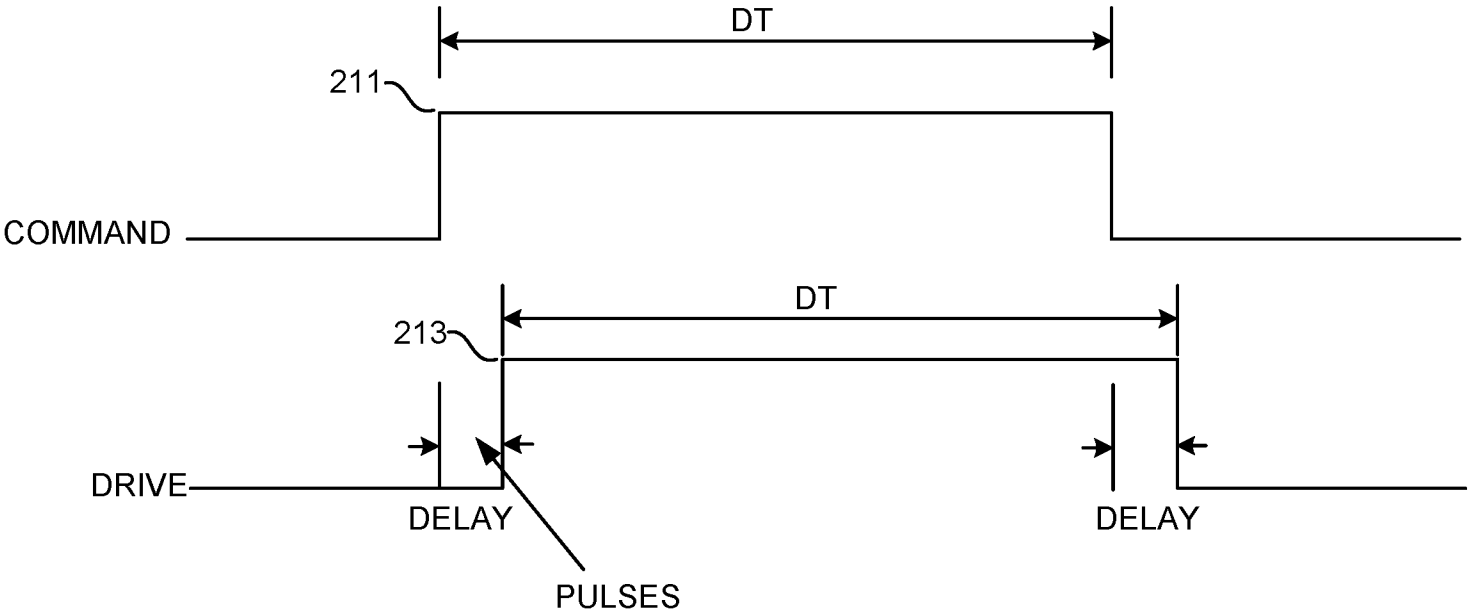
FIG. 2 is a signal timing diagram illustrating a command signal and a corresponding drive signal that can be implemented in the ignition circuit of FIG. 1.

FIG. 2 is a signal timing diagram that illustrates an example of a command signal 211 and a corresponding drive signal 213 in an ignition circuit, such as the ignition circuit 100 of FIG. 1, that can result in undesired voltage peaks (voltage spikes) in a secondary winding of the ignition coil 130, which can cause undesired sparking of the spark plug 140 (e.g., pre-ignition or engine knocking). For purposes of illustration, the timing diagram of FIG. 2 will be described with further reference to FIG. 1.

In the ignition circuit 100, the command signal 211 can be received, from the ECU 118, on the terminal 111 of the control circuit 110. The control circuit 110, in response to the command signal 211, can produce the drive signal 213, e.g., with a signal buffer or gate driver circuit included in the control circuit 110. In this example, the command signal 211 from the ECU 118 turns on (e.g., goes from logic low to logic high) and, after a period of time Delay, the drive signal 213 turns on (e.g., goes from logic low to logic high). As shown in FIG. 2, PULSES of a multi-pulse drive signal (such as the multi-pulse drive signals described herein) could be implemented in the drive signal 213 during the period of time Delay after the command signal turns on. As described herein, such PULSES can prevent undesired voltage spikes in a voltage of the secondary winding of the ignition coil 130 and prevent associated pre-ignition from occurring.

After a dwell time DT, the command signal 211 from the ECU turns off (goes to logic low), and, in response, the drive signal 213 from the control circuit 110 turns off after the period of time Delay. While the period of time Delay is shown as a same period of time for turning on and turning off the drive signal, depending on the particular implementation, these periods of time can be different from one another.

When operating the ignition circuit 100 using the signals of FIG. 2, the ECU 118 can provide the command signal 211 to the control circuit 110. The control circuit 110, in response to the command signal 211, can provide the drive signal 213 with the dwell time DT to the ignition IGBT 120. In response to the drive signal 213, the ignition IGBT can cause current to flow through a primary winding of the ignition coil 130 so as to store energy for later ignition (to generate a spark in the spark plug 140. When the ECU 118 determines that a spark is needed, the ECU 118 can turn off the command signal 211 and, in response, the control circuit 110 can turn off the drive signal 213, causing energy stored in the ignition coil 130 to produce a spark in the spark plug 140. After the spark is produced, the ECU 118 can turn the command signal 211 back on, causing the drive signal to also turn back on (e.g., such as in the timing sequence illustrated in FIG. 2), to again cause energy to be stored in the ignition coil 130 in preparation for a next spark event.

Figure 3:
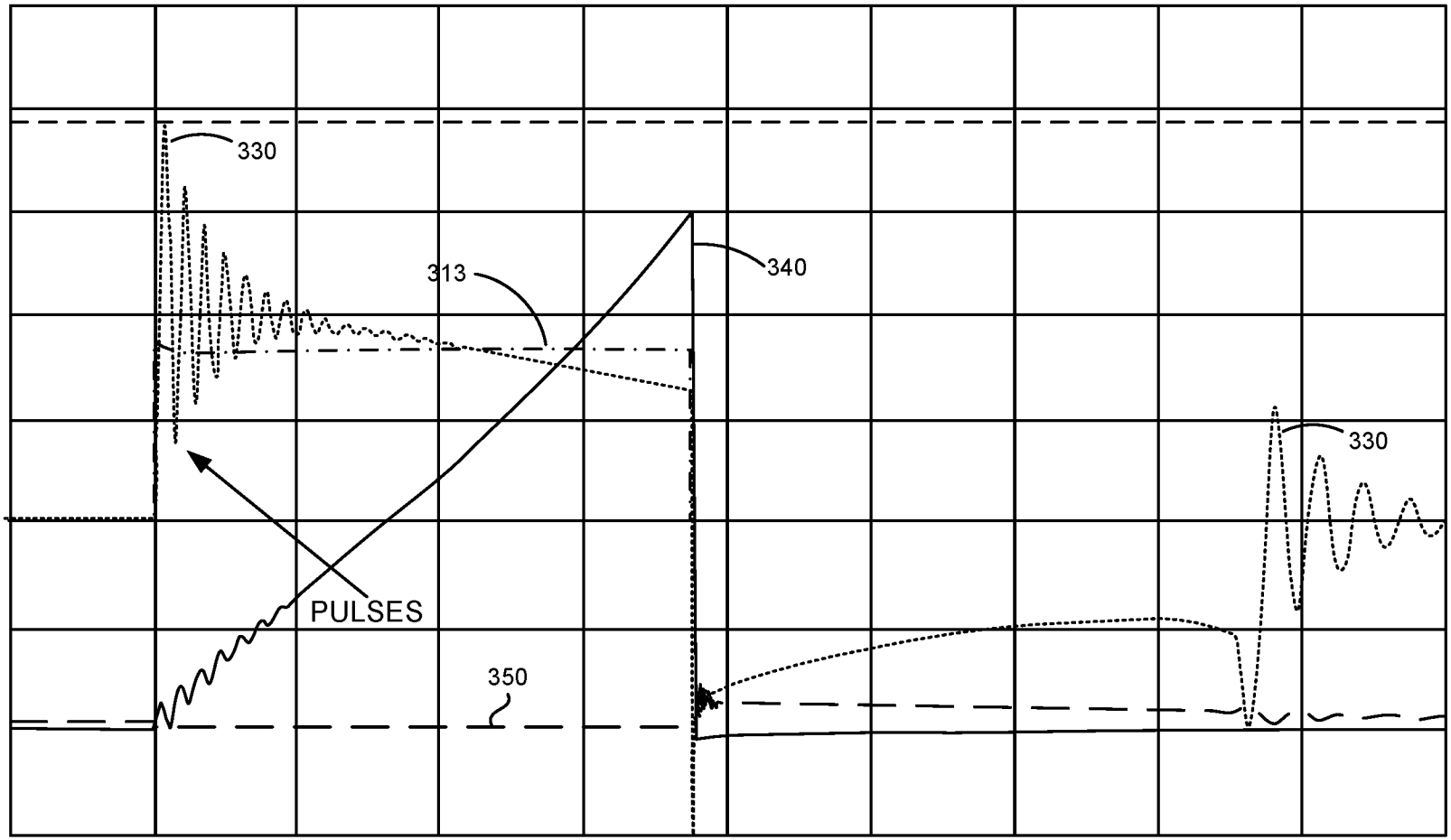
FIG. 3 is a signal timing diagram that illustrates a turn-on voltage spike measurement of the ignition circuit of FIG. 1A using the signals of FIG. 2.

FIG. 3 is a signal timing diagram that illustrates a voltage spike measurement on a secondary winding of an ignition coil of an ignition circuit, such as can occur in the ignition coil 130 of the ignition circuit 100 using the command signal 211 and the drive signal 213 of FIG. 2. Accordingly, for purposes of illustration, as with the discussion of FIG. 2 above, FIG. 3 will be described with further reference to the ignition circuit 100 of FIG. 1. As discussed above with respect to FIG. 2, PULSES of a multi-pulse drive signal, could be implemented at the beginning of a drive signal (such as indicated in FIG. 3), where such PULSES can prevent such voltage spikes on the secondary winding the ignition coil 130 of the ignition circuit 100.

The signal timing diagram of FIG. 3 illustrates a single ignition cycle for the ignition circuit 100. In FIG. 3, a number of signals of the ignition circuit 100 during the illustrated single ignition cycle are overlaid. As both voltage and current signals are shown in FIG. 3, and the value ranges of these signals vary, the signals are not shown to scale relative to one another. Further, for purposes of clarity, baselines of the signal traces in FIG. 3.

In FIG. 3, the signal trace 313 illustrates a voltage of a drive signal provided from the control circuit 110 to the ignition IGBT 120 (which directly corresponds with a command signal from the ECU 118 in this example), the signal trace 330 illustrates a voltage ($V_{sec}$) of the secondary winding of the ignition coil 130, the signal trace 340 illustrates a current ($I_{prim}$) of the primary winding of the ignition coil 130, and the signal trace 350 illustrates a collector-to-emitter voltage ($V_{ce}$) of the IGBT device 122. As shown by the signal trace 330 in FIG. 3, there is a turn-on voltage spike in $V_{sec}$ corresponding with the drive signal 313 going from logic low to logic high. In this example, the turn-on voltage spike of $V_{sec}$ is approximately 2.5 kilovolts (kV). Such a turn-on voltage spike may occur in the secondary winding of the ignition coil 130 due, at least in part, to inductive resonance and parasitic capacitance of the ignition coil 130. In some implementations, such as the ignition circuit 100, turn-on voltage spikes of greater than approximately 2 kV can cause undesired sparking from the spark plug, which can result in pre-ignition or engine knocking in an associated engine cylinder.

In some ignition circuit implementations, limiting a peak voltage (e.g. turn-on voltage spikes, or otherwise) in a secondary winding of an ignition coil ($V_{sec}$), when charging the ignition coil prior to inducing spark in a spark plug, can prevent undesired sparking of the spark plug. For instance, in the ignition circuit 100 of FIG. 1, limiting the peak voltage of the secondary winding of the ignition coil 130 to 2 kV or less during charging of the ignition coil 130 can prevent such undesired sparking (pre-ignition or engine knocking).

One approach that has been used to minimize such ignition coil spike voltages and corresponding undesired sparking is to include a high-voltage diode on the spark-plug side of the ignition coil (e.g., coupled with the secondary winding). While such use of a high-voltage diode can suppress secondary winding voltage spikes (e.g., turn-on voltage spikes), the inclusion of the high-voltage diode adds manufacturing cost to the ignition circuit. Other approaches that have been used to minimize such ignition coil spike voltages and corresponding undesired sparking without the use of a high-voltage diode to suppress such voltage spikes include using either a phased turn-on of an ignition IGBT or slow ramping (of a gate voltage) of an ignition IGBT.

In the phased turn-on method, delivery of a drive signal that includes a single, short-duration pulse with a predetermined (e.g., 50%) duty cycle (a percentage of time of the entire pulse cycle that the drive signal is logic high) prior to a dwell time (e.g., where the drive signal remains at logic high) can help reduce a spike voltage observed on a secondary winding of an associated ignition coil (e.g., below 2 kV). However, the results achieved in such phased turn-on approaches can be dependent on variations of the pulse width (i.e., dependent on a pulse cycle time with a 50% duty cycle) and operating parameters of an associated ignition coil. Further, a pulse duration, or a duty cycle for a given pulse cycle time, produced by an ignition circuit's control circuit can vary from circuit to circuit. The combination of pulse (e.g., duration and/or duty cycle) variance and ignition coil parameter variance can compound, causing significant variation in a spike voltage from ignition circuit to ignition circuit, even within a given vehicle's engine. As an example of the dependence on variation of pulse cycle duration and pulse width (without considering the effects of ignition coil parameter variance), testing of at least one implementation of the ignition circuit 100 of FIG. 1 demonstrated that, using a phased turn-on approach, pulse cycle times (with 50% duty cycle) between 28 microseconds (μs) and 41 μs (only +/−19% variation from a median of 34.5 μs) prevented secondary voltage spikes above 2 kV.

In the slow-ramping method, instead of using a drive signal with a single fast rising edge (such as the drive signal 213 in FIG. 2), circuitry can be can be included in an ignition circuit's control circuit, where that added circuitry can be configured to produce a slow ramp up for at least part of the drive signal turn-on (e.g., on a gate terminal of an ignition IGBT). While the slow ramping approach can reduce spike voltages on a secondary winding of a corresponding ignition coil such approaches are, however, subject to significant performance variability over temperature due, at least in part, to temperature dependent characteristics of ignition IGBTs and variability from IGBT device to IGBT device.

Using a multi-pulse drive signal, such as in the approaches described herein, such as those discussed below with respect to FIGS. 4-10, voltages spikes (e.g., on a secondary winding of an ignition coil) can be reduced (or eliminated) as compared to the approach discussed above with respect to FIGS. 2 and 3 (e.g., reduced below 2 kV) over a larger range of pulse variations (pulse width and pulse cycle time variations) than the phased turn-on approach, and also over a larger temperature range than the slow ramp approach. Briefly, in at least one implementation of the ignition circuit 100 of FIG. 1 that implements a multi-pulse drive signal, the control circuit 100 can, in response to a command signal from the ECU 118, provide a drive signal to the ignition IGBT 120 that includes a series of pulses (e.g., 2 or more pulses, 4 or more pulses, etc.) prior to a dwell time of the drive signal, where the drive signal remains at logic high and current flows through the primary winding of the ignition coil 130 to store energy for initiating a spark in the spark plug 140.

In some implementations, respective duty cycles of each successive pulse of the multiple pulses can be increased while the overall pulse cycle time for each pulse remains constant. In other words, the duty cycle for each successive pulse can be increased with respect to a previous pulse, while the overall pulse cycle time for each pulse (e.g., from a pulse's rising edge to a next pulse's rising edge) remains constant (e.g., substantially constant within operating tolerances of a corresponding control circuit). In such approaches, a total time during which the multiple pulses of a multi-pulse drive signal are provided can be significantly less than the dwell time of the multi-pulse. In some implementations, a delay time (e.g., equal to a time period during which the multiple pulses are provided) can be added to the dwell time portion of the multi-pulse drive signal (e.g., where the drive signal remains at logic high for the delay time after the falling edge of the command signal from an ECU). This added delay time can compensate for loss of dwell time (charging of the ignition coil) due to the time used for delivering the multiple pulses of the gate of the ignition IGBT. As discussed in further detail below, implementing a multi-pulse drive signal in an ignition circuit, such as the ignition circuit 100 of FIG. 1, that includes four or more pulses with increasing duty cycle and constant pulse cycle duration, voltage spike variance in the secondary winding of the ignition coil 130 due to pulse duration variation (as compared to phase on approaches) and temperature variance (as compared to slow ramp on approaches) can become relatively insignificant.

Figure 4:
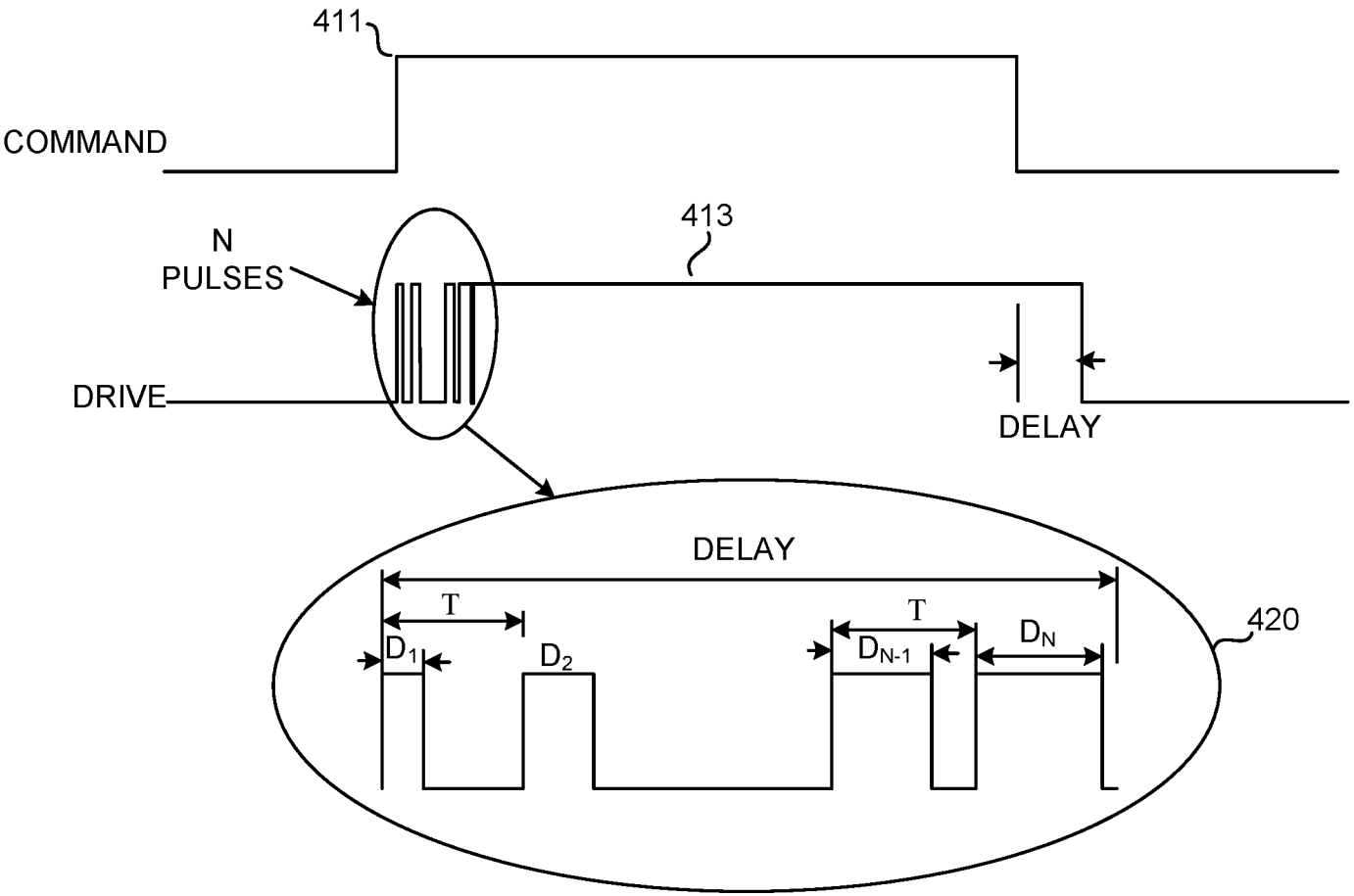
FIG. 4 is a diagram that schematically illustrates a command signal and a corresponding multi-pulse drive signal.

FIG. 4 is a diagram that schematically illustrates signals, including a multi-pulse drive signal, that can be implemented in an ignition circuit, such as the ignition circuit 100 of FIG. 1. Accordingly, for purposes of illustration, the diagram of FIG. 4 will be described with further reference to FIG. 1. In the multi-pulse approach illustrated in FIG. 4, a command signal 411 can be provided from the ECU 118 to the control circuit 110 of the ignition circuit 100. In response to the command signal 411, the control circuit 110 can provide a multi-pulse drive signal 413 to the ignition IGBT 120. In some implementations, the command signal 411 from the ECU 118 can be turned on for a desired dwell time. At the conclusion of the desired dwell time, the command signal 413 from the ECU 118 can be turned off.

As shown in FIG. 4, in response to the command signal 411 being turned on (going to from logic low to logic high), the control circuit 110 may emit, as part of the multi-pulse drive signal 413, a series of N pulses (e.g., where N is 2 or more, 4 or more, etc.) prior to turning on the multi-pulse drive signal 413 for the dwell time (during which the multi-pulse drive signal 413 remains logic high to store energy for initiating a spark in the ignition coil 130). As shown in FIG. 4, a highlight is included on the multi-pulse drive signal 413, where the highlight indicates the portion of the multi-pulse drive signal during which the N pulses are emitted. In FIG. 4, the N pulses (having respective durations of D1, D2 . . . $D_{n-1}$, $D_n$ for the pulses shown in FIG. 4) within the highlight on the multi-pulse drive signal 413 are schematically illustrated in a magnified view 420 in FIG. 4.

As shown in the magnified view 420 in FIG. 4, a cycle time T can remain constant (e.g., substantially constant within operating tolerances of the control circuit 110) for each of the N pulses, while a pulse width (duty cycle) of each successive pulse increases. In other words, a duration (pulse width) $D_1$ (or duty cycles) of the first pulse shown in the magnified view 420 is less than a duration (or duty cycle) of later pulses (e.g., the second duration $D_2$, the third duration $D_{n-1}$ and the fourth duration $D_n$ shown in the magnified view 420).

In response to the command signal 411 turning off (going from logic high to logic low), the multi-pulse drive signal 413 may, after a delay time Delay, turn off, causing current to stop flowing in a primary winding of the ignition coil 130 and initiating a spark in the spark plug 140. The delay time Delay, as shown in magnified view 420, can be equal to an amount of time during which the multiple N pulses of the multi-pulse drive signal are provided to the ignition IGBT 120 by the control circuit 110. The delay time Delay can, in some implementations, add time to the dwell period (during which the inductor is storing energy) to compensate for the amount of time (Delay in this example) that is used in to emit the N pulses of the multi-pulse drive signal 413. In some implementations, the delay time Delay added to the dwell period can be equal to the total time of the N pulse cycles (as shown in FIG. 4), can be less than the total time of the N pulse cycles, or can be greater than the total time of the N pulse cycles. As described herein, in some implementations, a duty cycle of each of the N pulses can increase with each successive pulse, while a cycle time T of each pulse (e.g., a time from a first pulse's rising edge to a next rising edge, whether a next pulse's rising edge or a rising edge at a start of the dwell time/period) remains constant.

Figure 5:
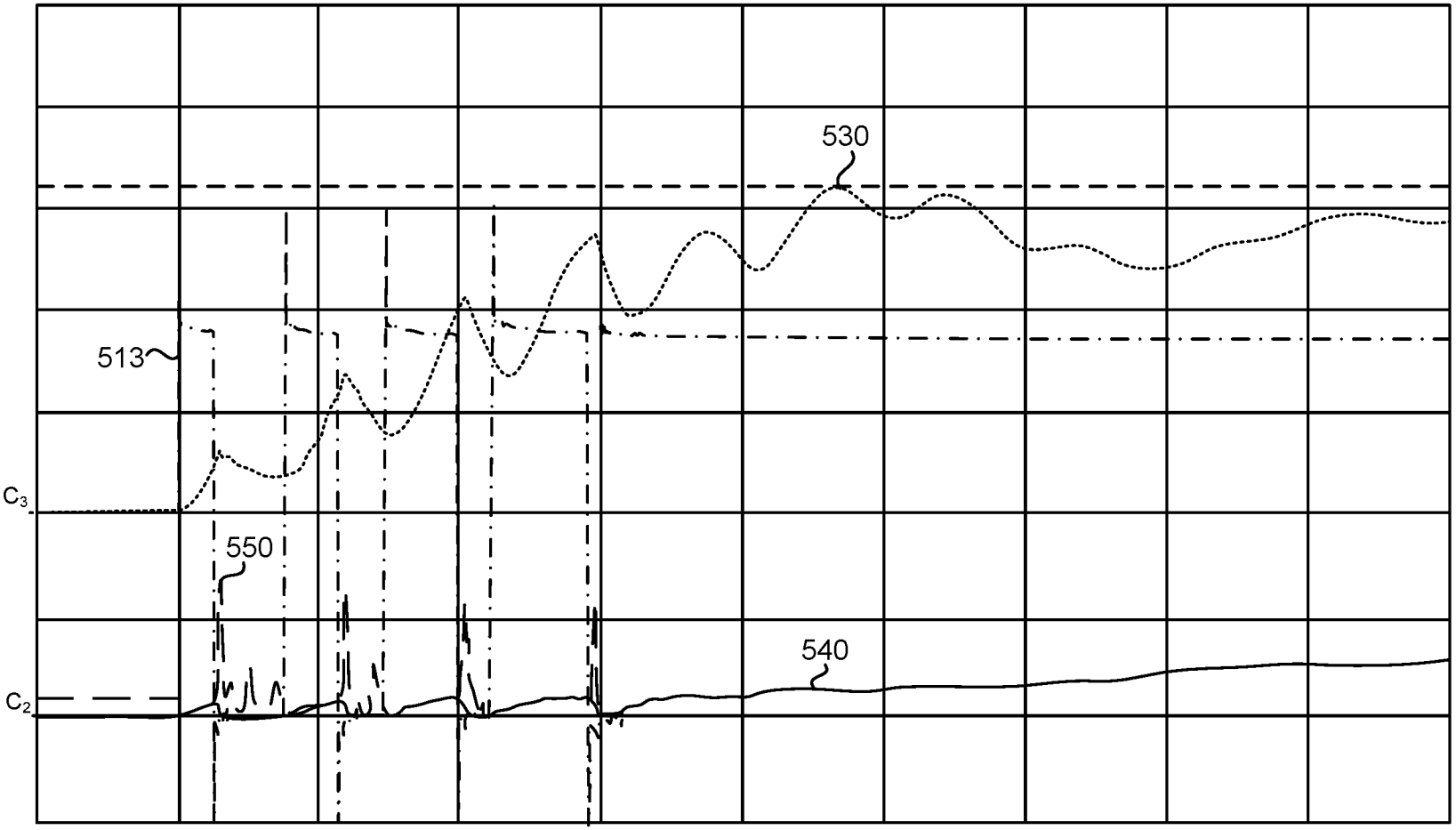
FIG. 5 is a signal timing diagram that illustrates a multi-pulse drive signal that can be implemented in the ignition circuit of FIG. 1A and control circuit of FIG. 1B, and a corresponding voltage on a secondary winding of an ignition coil of the ignition circuit of FIG. 1A.

FIG. 5 is a signal timing diagram that illustrates test results corresponding with implementation of a multi-pulse drive signal (with four pulses) in an ignition circuit, such as the ignition circuit 100 of FIG. 1. Accordingly, for purposes of illustration, the signal timing diagram of FIG. 5 is described with further reference to FIG. 1.

In FIG. 5, as in FIG. 3, a number of signals of the ignition circuit 100 during a single multi-pulse ignition sequence are overlaid. As both voltage and current signals are shown in FIG. 5, and the value ranges of these signals vary, the signals are not shown to scale relative to one another. Further, for purposes of clarity, baselines of the signal traces in FIG. 5 may be shifted on the y-axis so that each signal can be distinguished from the others.

In FIG. 5, the signal trace 513 illustrates a voltage of a multi-pulse drive signal provided from the control circuit 110 to the ignition IGBT 120 (which multi-pulse drive signal is generated by the control circuit 110 in response to a command signal from the ECU 118 in this example), the signal trace 530 illustrates a voltage ($V_{sec}$) of the secondary winding of the ignition coil 130, the signal trace 540 illustrates a current ($I_{prim}$) of the primary winding of the ignition coil 130, and the signal trace 550 illustrates a collector-to-emitter voltage ($V_{ce}$) of the IGBT device 122. In this example, a peak of the voltage $V_{sec}$ 1.6 kV was observed, which is below the 2 kV threshold discussed above, below the 2.5 kV shown in FIG. 3 (for the timing approach of FIG. 2 implemented in a same ignition circuit), and also below the 1.9 kV observed for a phased turn-on approach in a same ignition circuit.

In the approach illustrated in FIG. 5, the four pulses of the multi-pulse drive signal 513 have constant pulse cycle durations and increasing pulse widths (duty cycles) for each successive pulse cycle. Such multi-pulse ignition sequence approaches can allow a voltage at a secondary side of the ignition coil 130 (a spark-plug side of the ignition coil 130) to rise more slowly than using the approach of FIG. 2, or a phased turn-on approach, resulting in a reduction in a peak voltage (e.g., voltage spiking) in the secondary winding of the ignition coil 130.

Figure 6:
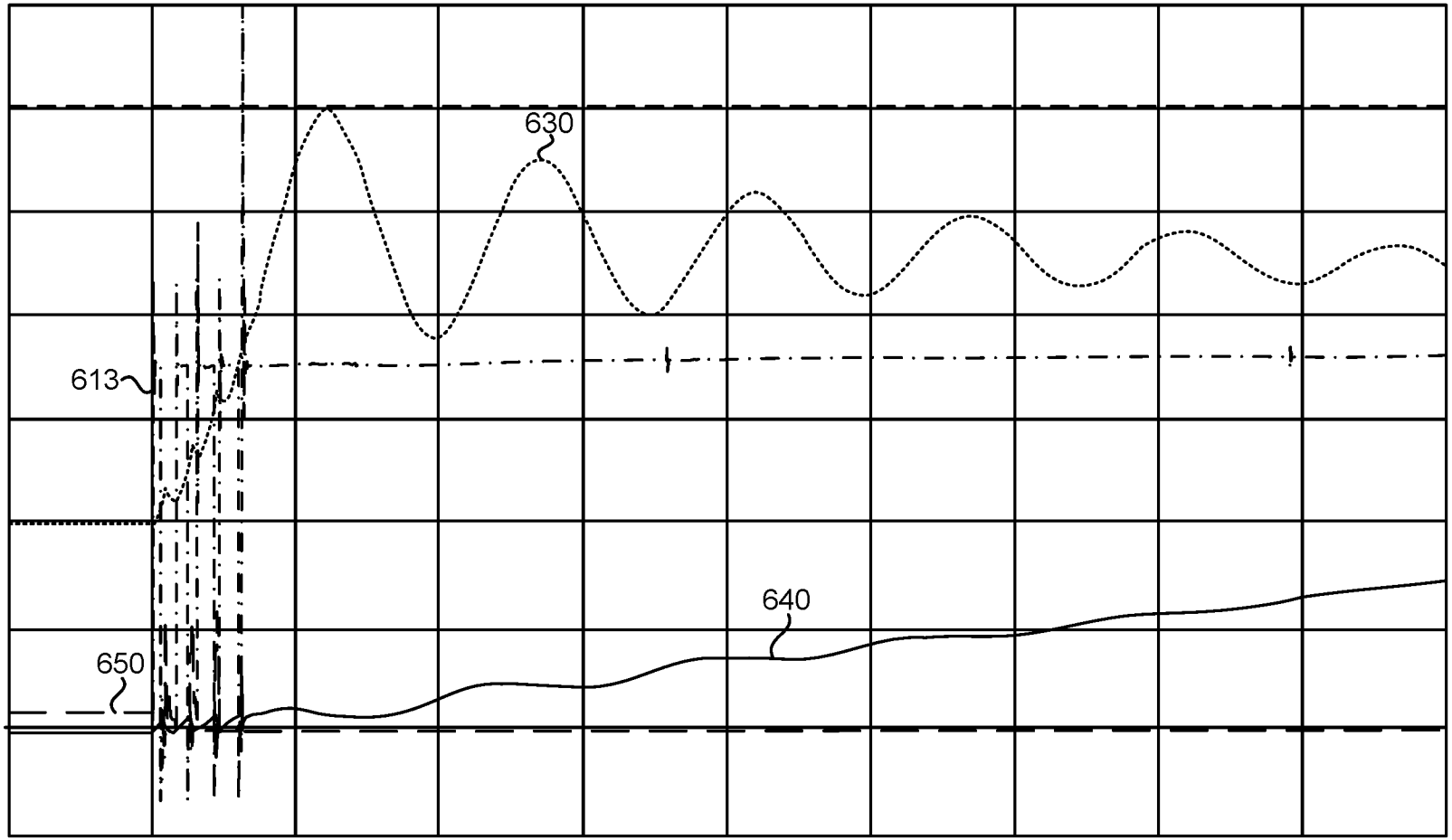
FIGS. 6 and 7 are signal timing diagrams that illustrate a range of pulse cycle times that can be implemented using a multi-pulse drive signal in the ignition circuit of FIG. 1A and control circuit of FIG. 1B.
Figure 7:
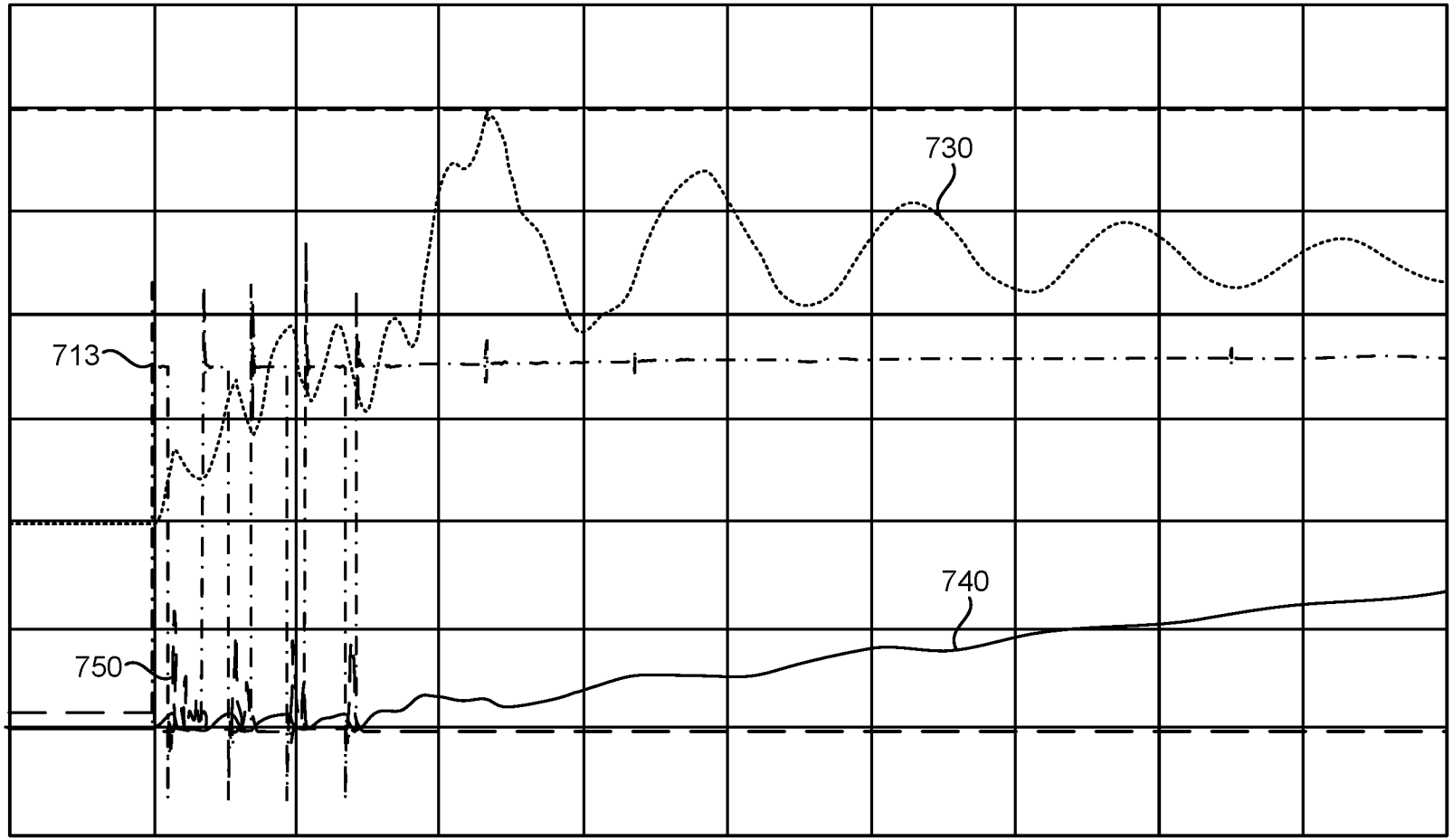

FIGS. 6 and 7 are signal timing diagrams that illustrate a range of pulse cycle times that can be implemented using a multi-pulse drive signal in the ignition circuit of FIG. 1. That is, FIGS. 6 and 7 are signal timing diagrams that illustrate operation of the ignition circuit of FIG. 1 using a multi-pulse drive signal (with four pulses having increasing pulse widths) over a range of pulse cycle times in the ignition circuit 100. Accordingly, for purposes of illustration, the signal timing diagrams of FIGS. 6 and 7 are described with further reference to FIG. 1.

In FIGS. 6 and 7, as in FIGS. 3 and 5, a number of signals of the ignition circuit 100 during a single multi-pulse ignition sequence are overlaid. As both voltage and current signals are shown in FIGS. 6 and 7, and the value ranges of these signals vary, the signals are not shown to scale relative to one another. Further, for purposes of clarity, baselines of the signal traces in FIGS. 6 and 7 may be shifted on the y-axis so that each signal can be distinguished from the others.

In FIG. 6, the signal trace 613 illustrates a voltage of a multi-pulse drive signal provided from the control circuit 110 to the ignition IGBT 120 (which multi-pulse drive signal is generated by the control circuit 110 in response to a command signal from the ECU 118 in this example), the signal trace 630 illustrates a voltage ($V_{sec}$) of the secondary winding of the ignition coil 130, the signal trace 640 illustrates a current ($I_{prim}$) of the primary winding of the ignition coil 130, and the signal trace 650 illustrates a collector-to-emitter voltage ($V_{ce}$) of the IGBT device 122. In this example, the ignition circuit 100 was operated with a multi-pulse drive signal with four pulses with increasing pulse widths (duty cycles) and a constant pulse cycle time of 8 μs. In the example of FIG. 6, a peak voltage $V_{sec}$ of less than 2 kV in the voltage $V_{sec}$ was observed.

In FIG. 7, the signal trace 713 illustrates a voltage of a multi-pulse drive signal provided from the control circuit 110 to the ignition IGBT 120 (which multi-pulse drive signal is generated by the control circuit 110 in response to a command signal from the ECU 118 in this example), the signal trace 730 illustrates a voltage ($V_{sec}$) of the secondary winding of the ignition coil 130, the signal trace 740 illustrates a current ($I_{prim}$) of the primary winding of the ignition coil 130, and the signal trace 750 illustrates a collector-to-emitter voltage ($V_{ce}$) of the IGBT device 122. In this example, the ignition circuit 100 was operated with a multi-pulse drive signal with four pulses with increasing pulse widths (duty cycles matching those of FIG. 6) and a constant pulse cycle time of 18 μs. In the example of FIG. 7, a peak of less than 2 kV in the voltage $V_{sec}$ was observed.

As can be seen from FIGS. 6 and 7, using a multi-pulse drive signal for implementing an ignition sequence allows for pulse cycle times (using four pulses with increasing duty cycles) between 8 μs (32 μs overall) and 18 μs (72 μs overall). In this example, pulse cycles with a +/−38.5% variation in duration from a median of 13 μs prevented secondary voltage spikes above 2 kV, indicating that sensitivity to pulse cycle duration is significantly reduced using multi-pulse approaches as compared to phased turn-on approaches. While FIGS. 6 and 7 (as well as FIGS. 5 and 8-10 are illustrated using four pulses with increasing width/increasing duty cycle), in some implementations, other numbers of pulses can be used (e.g., 2, 3, or 4 or more). Generally, using more pulses can provide decreased sensitivity to pulse cycle duration, with the number of pulses that are used being limited, for example, by pulse cycle duration and an amount of time available (e.g., a lower limit) for providing pulses in a multi-pulse ignition sequence.

Figure 8:
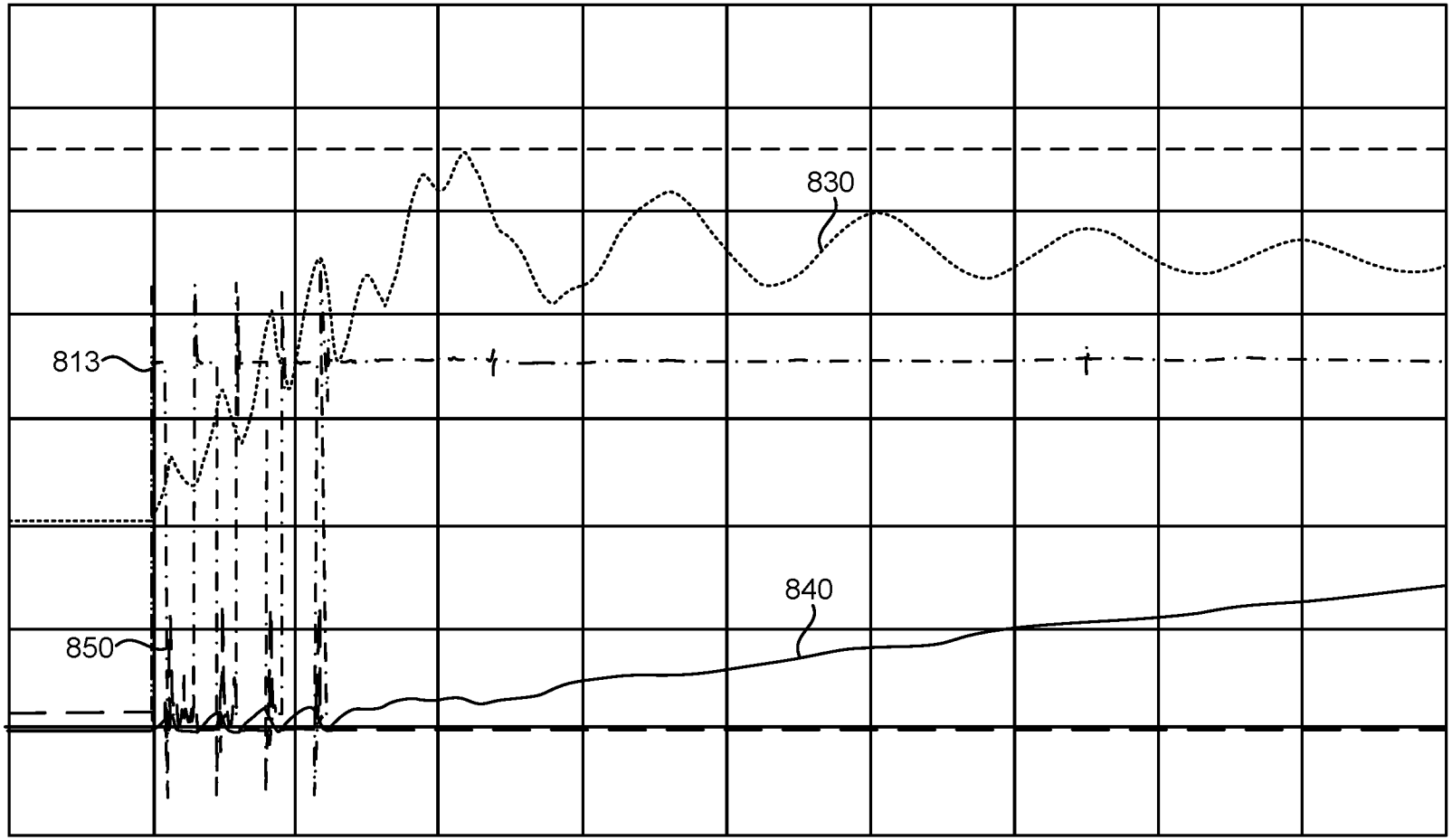
FIGS. 8, 9 and 10 are signal timing diagrams that illustrate operation of the ignition circuit of FIG. 1A and control circuit of FIG. 1B using a multi-pulse drive signal over a range of temperatures.
Figure 9:
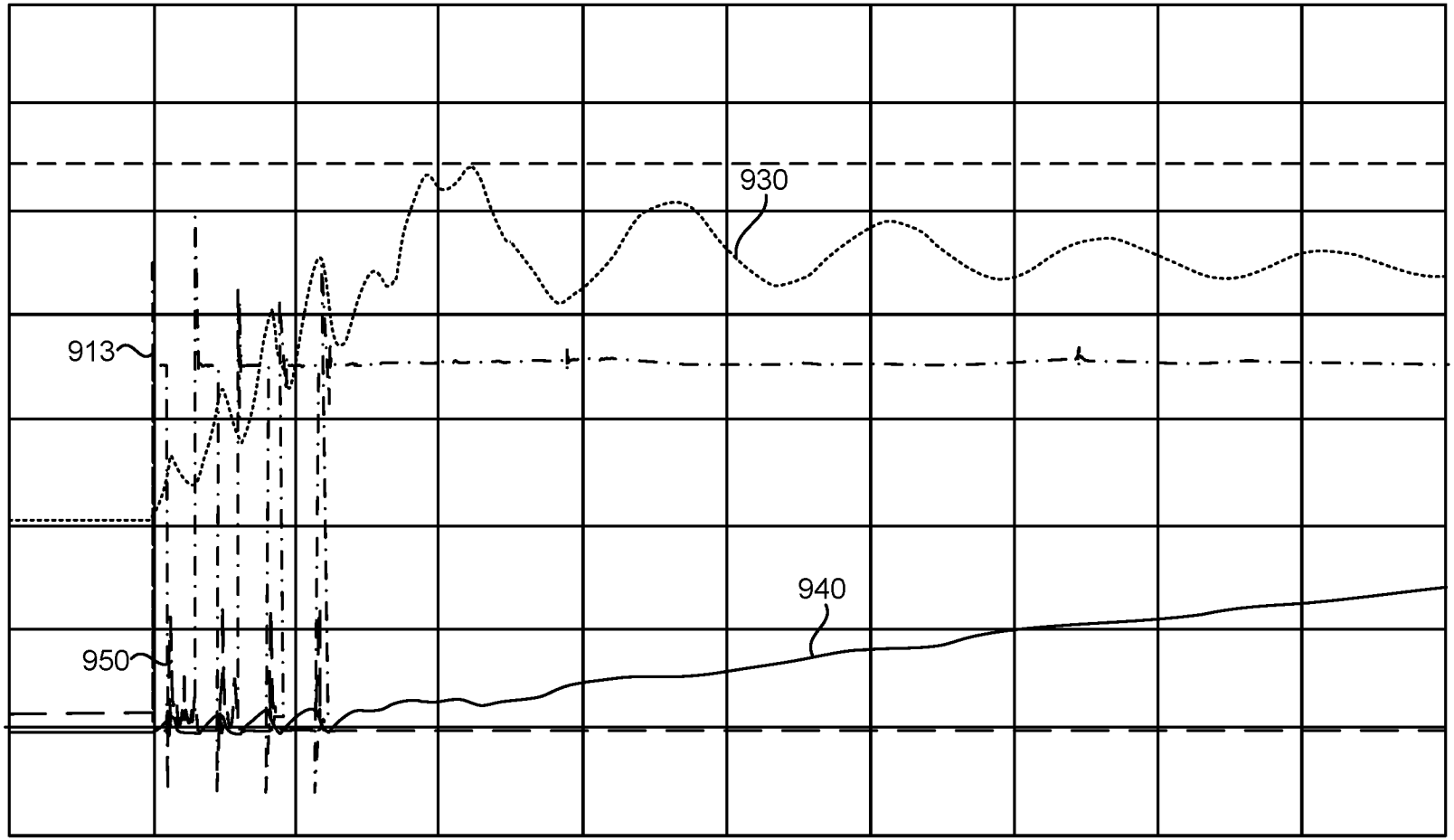
Figure 10:
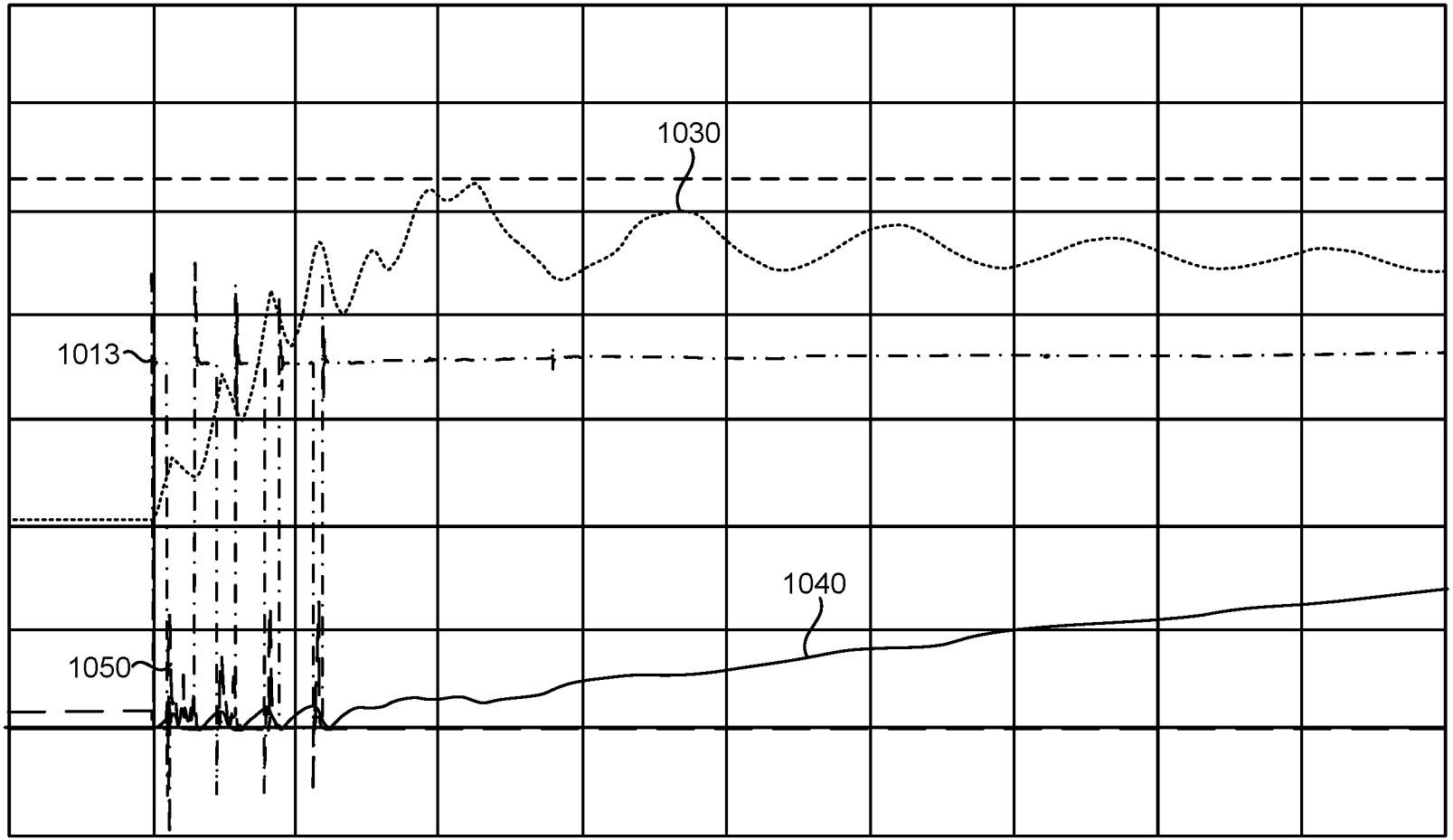

FIGS. 8, 9 and 10 are signal timing diagrams that illustrate operation of the ignition circuit of FIG. 1 using a multi-pulse drive signal (with four pulses with increasing pulse widths with equivalent duty cycles and a constant pulse cycle time)

over a range of temperatures for the ignition circuit 100. Accordingly, for purposes of illustration, the signal timing diagrams of FIGS. 8-10 are described with further reference to FIG. 1.

In FIGS. 8-10, as in FIGS. 3, 5, 6 and 7, a number of signals of the ignition circuit 100 during a single multi-pulse ignition sequence are overlaid. As both voltage and current signals are shown in FIGS. 8-10, and the value ranges of these signals vary, the signals are not shown to scale relative to one another. Further, for purposes of clarity, baselines of the signal traces in FIGS. 8-10 may be shifted on the y-axis so that each signal can be distinguished from the others.

In FIG. 8, the signal trace 813 illustrates a voltage of a multi-pulse drive signal provided from the control circuit 110 to the ignition IGBT 120 (which multi-pulse drive signal is generated by the control circuit 110 in response to a command signal from the ECU 118 in this example), the signal trace 830 illustrates a voltage ($V_{sec}$) of the secondary winding of the ignition coil 130, the signal trace 840 illustrates a current ($I_{prim}$) of the primary winding of the ignition coil 130, and the signal trace 850 illustrates a collector-to-emitter voltage ($V_{ce}$) of the IGBT device 122. In this example, the ignition circuit 100 was operated at a temperature (ambient temperature) of −40 degrees Celsius and a peak of the voltage $V_{sec}$ 1.788 kV was observed.

In FIG. 9, the signal trace 913 illustrates a voltage of a multi-pulse drive signal provided from the control circuit 110 to the ignition IGBT 120 (which multi-pulse drive signal is generated by the control circuit 110 in response to a command signal from the ECU 118 in this example), the signal trace 930 illustrates a voltage ($V_{sec}$) of the secondary winding of the ignition coil 130, the signal trace 940 illustrates a current ($I_{prim}$) of the primary winding of the ignition coil 130, and the signal trace 950 illustrates a collector-to-emitter voltage ($V_{ce}$) of the IGBT device 122. In this example, the ignition circuit 100 was operated at a temperature (ambient temperature) of 25 degrees Celsius and a peak of the voltage $V_{sec}$ 1.727 kV was observed.

In FIG. 10, the signal trace 1013 illustrates a voltage of a multi-pulse drive signal provided from the control circuit 110 to the ignition IGBT 120 (which multi-pulse drive signal is generated by the control circuit 110 in response to a command signal from the ECU 118 in this example), the signal trace 1030 illustrates a voltage ($V_{sec}$) of the secondary winding of the ignition coil 130, the signal trace 1040 illustrates a current ($I_{prim}$) of the primary winding of the ignition coil 130, and the signal trace 1050 illustrates a collector-to-emitter voltage ($V_{ce}$) of the IGBT device 122. In this example, the ignition circuit 100 was operated at a temperature (ambient temperature) of 125 degrees Celsius and a peak of the voltage $V_{sec}$ 1.645 kV was observed. As can be seen from the test results presented in FIGS. 8-10, using a multi-pulse ignition sequence, such as those described herein, peak secondary voltages under 2 kV, with a variation of less than 9% over a 165 degree Celsius temperature range can be achieved.

In a first example, a method can include receiving, at a control circuit from an engine control unit, a command signal. The method can also include, in response to the command signal, generating a multi-pulse drive signal. The multi-pulse drive signal can include, in sequence, a first pulse cycle having a first duty cycle, a second pulse cycle having a second duty cycle, and a dwell period during which the multi-pulse drive signal continuously remains at a logic high value. The method can further include providing the multi-pulse drive signal to a control terminal of an ignition switch. The method can still further include, in response to the multi-pulse drive, signal storing energy in an ignition coil using current conducted through the ignition coil by the ignition switch, and initiating, with the energy stored in the ignition coil, a spark in a spark plug coupled with the ignition coil.

In a second example based on the first example, the first duty cycle can be less than the second duty cycle.

In a third example based on any one of the first and second examples, a cycle time of the first pulse cycle can be substantially equal to a cycle time of the second pulse cycle.

In a fourth example, based on any one of the first through third examples, the multi-pulse drive signal can include a third pulse cycle in sequence after the second pulse cycle and before the dwell period, the third pulse cycle having a third duty cycle that is greater than the second duty cycle.

In a fifth example based on the fourth example, the multi-pulse drive signal can include a fourth pulse cycle in sequence after the third pulse cycle and before the dwell period, the fourth pulse cycle having a fourth duty cycle that is greater than the third duty cycle.

In a sixth example based on the fifth example, a cycle time of the first pulse cycle, a cycle time of the second pulse cycle, a cycle time of the third pulse cycle and a cycle time of the fourth pulse cycle can be substantially equal.

In a seventh example based on the sixth example, the dwell period can include a delay corresponding with a period of time of time used to provide the first pulse cycle, the second pulse cycle, the third pulse cycle and the fourth pulse cycle. The delay can occur after the command signal changes from a logic high value to a logic low value.

In an eighth example based any one of the first through third examples, the dwell period can include a delay corresponding with a period of time of time used to provide the first pulse cycle and the second pulse cycle, the delay occurring after the command signal changes from a logic high value to a logic low value.

In a ninth example based on any one of the first through eighth examples, the first pulse cycle can include a pulse that has a width that is less than a width of a pulse of the second pulse cycle.

In a tenth example, an ignition circuit can include a control circuit that is coupled with an engine control unit (ECU) to receive a command signal from the ECU. The control circuit can include a multi-pulse generator configured to, in response to the command signal, generate a multi-pulse drive signal. The multi-pulse drive signal can include a first pulse cycle having a first duty cycle, a second pulse cycle having a second duty cycle, and a dwell period during which the multi-pulse drive signal continuously remains at a logic high value. The control circuit can be configured to provide the multi-pulse drive signal to an ignition switch coupled with the control circuit to receive the multi-pulse drive signal.

In an eleventh example based on the tenth example, the ignition switch can be configured, in response to the multi-pulse drive signal, to store energy in an ignition coil coupled with the ignition switch using current conducted through the ignition coil by the ignition switch, and initiate, with the energy stored in the ignition coil, a spark in a spark plug coupled with the ignition coil.

In a twelfth example based on any one of the tenth and eleventh examples, the ignition switch can include an ignition insulated-gate bipolar transistor (IGBT).

In a thirteenth example based on the twelfth example, the ignition IGBT can include an IGBT, and a resistor-diode network defining a voltage clamp of the ignition circuit.

In a fourteenth example based on any one of the tenth through thirteenth examples, the first duty cycle can be less than the second duty cycle.

In a fifteenth example based on any one of the tenth through fourteenth examples, a cycle time of the first pulse cycle can be substantially equal to a cycle time of the second pulse cycle.

In a sixteenth example based on any one of the tenth through fourteenth examples, the multi-pulse drive signal can include a third pulse cycle in sequence after the second pulse cycle and before the dwell period. The third pulse cycle can have a third duty cycle that is greater than the second duty cycle.

In a seventeenth example based on the sixteenth example, the multi-pulse drive signal can include a fourth pulse cycle in sequence after the third pulse and before the dwell period. The fourth pulse cycle can have a fourth duty cycle that is greater than the third duty cycle.

In an eighteenth example based the seventeenth example, a cycle time of the first pulse cycle, a cycle time of the second pulse cycle, a cycle time of the third pulse cycle and a cycle time of the fourth pulse cycle are substantially equal.

In a nineteenth example based on any one of the tenth through fourteenth examples, the dwell period can include a delay corresponding with a period of time used to provide the first pulse cycle and the second pulse cycle. The delay can occur after the command signal changes from a logic high value to a logic low value.

In a twentieth example based on any one of the tenth through nineteenth examples, the first pulse cycle can include a pulse that has a width that is less than a width of a pulse of the second pulse cycle.

The foregoing description includes references to the accompanying drawings, which form a part of the detailed description. The drawings show, by way of illustration, specific embodiments in which the disclosure can be practiced. These embodiments are also referred to herein as "examples." Such examples can include elements in addition to those shown or described. However, examples in which only those elements shown or described are provided are also contemplated. Moreover, examples using any combination or permutation of those elements shown or described (or one or more aspects thereof), either with respect to a particular example (or one or more aspects thereof), or with respect to other examples (or one or more aspects thereof) shown or described herein are further contemplated.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and/or "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Certain examples can include a computer-readable medium or machine-readable medium encoded with instructions operable to configure an electronic device to perform methods as described in the above examples. In at least one implementation of such methods can include code, such as microcode, assembly language code, a higher-level language code, or the like. Such code can include computer readable instructions for performing various methods. The code may form portions of computer program products. Further, the code can be tangibly stored on one or more volatile or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art, upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, patentable subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations.

What is claimed is:

1. A method comprising:

receiving, at a control circuit from an engine control unit, a command signal;

in response to the command signal, generating a multi-pulse drive signal, the multi-pulse drive signal including, in sequence:

a first pulse cycle having a first duty cycle;

a second pulse cycle having a second duty cycle; and a dwell period during which the multi-pulse drive signal continuously remains at a logic high value;

providing the multi-pulse drive signal to a control terminal of an ignition switch; and in response to the multi-pulse drive signal:

storing energy in an ignition coil using current conducted through the ignition coil by the ignition switch; and initiating, with the energy stored in the ignition coil, a spark in a spark plug coupled with the ignition coil.

2. The method of claim 1, wherein the first duty cycle is less than the second duty cycle.

3. The method of claim 1, wherein a cycle time of the first pulse cycle is substantially equal to a cycle time of the second pulse cycle.

4. The method of claim 1, wherein the multi-pulse drive signal further includes:

a third pulse cycle in sequence after the second pulse cycle and before the dwell period, the third pulse cycle having a third duty cycle that is greater than the second duty cycle.

5. The method of claim 4, wherein the multi-pulse drive signal further includes:

a fourth pulse cycle in sequence after the third pulse cycle and before the dwell period, the fourth pulse cycle having a fourth duty cycle that is greater than the third duty cycle.

6. The method of claim 5, wherein a cycle time of the first pulse cycle, a cycle time of the second pulse cycle, a cycle time of the third pulse cycle and a cycle time of the fourth pulse cycle are substantially equal.

7. The method of claim 5, wherein the dwell period includes a delay corresponding with a period of time of time used to provide the first pulse cycle, the second pulse cycle, the third pulse cycle and the fourth pulse cycle, the delay occurring after the command signal changes from a logic high value to a logic low value.

8. The method of claim 1, wherein the dwell period includes a delay corresponding with a period of time of time used to provide the first pulse cycle and the second pulse cycle, the delay occurring after the command signal changes from a logic high value to a logic low value.

9. The method of claim 1, wherein the first pulse cycle includes a pulse that has a width that is less than a width of a pulse of the second pulse cycle.

10. An ignition circuit comprising:

a control circuit that is coupled with an engine control unit (ECU) to receive a command signal from the ECU, the control circuit including a multi-pulse generator configured to, in response to the command signal, generate a multi-pulse drive signal including:

a first pulse cycle having a first duty cycle;

a second pulse cycle having a second duty cycle; and a dwell period during which the multi-pulse drive signal continuously remains at a logic high value, the control circuit being configured to provide the multi-pulse drive signal to an ignition switch coupled with the control circuit to receive the multi-pulse drive signal.

11. The ignition circuit of claim 10, wherein the ignition switch is configured, in response to the multi-pulse drive signal, to:

store energy in an ignition coil coupled with the ignition switch using current conducted through the ignition coil by the ignition switch; and initiate, with the energy stored in the ignition coil, a spark in a spark plug coupled with the ignition coil.

12. The ignition circuit of claim 10, wherein the ignition switch includes an ignition insulated-gate bipolar transistor (IGBT).

13. The ignition circuit of claim 12, wherein the ignition IGBT includes:

an IGBT; and a resistor-diode network defining a voltage clamp of the ignition circuit.

14. The ignition circuit of claim 10, wherein the first duty cycle is less than the second duty cycle.

15. The ignition circuit of claim 10, wherein a cycle time of the first pulse cycle is substantially equal to a cycle time of the second pulse cycle.

16. The ignition circuit of claim 10, wherein the multi-pulse drive signal further includes:

a third pulse cycle in sequence after the second pulse cycle and before the dwell period, the third pulse cycle having a third duty cycle that is greater than the second duty cycle.

17. The ignition circuit of claim 16, wherein the multi-pulse drive signal further includes:

a fourth pulse cycle in sequence after the third pulse cycle and before the dwell period, the fourth pulse cycle having a fourth duty cycle that is greater than the third duty cycle.

18. The ignition circuit of claim 17, wherein a cycle time of the first pulse cycle, a cycle time of the second pulse cycle, a cycle time of the third pulse cycle and a cycle time of the fourth pulse cycle are substantially equal.

19. The ignition circuit of claim 10, wherein the dwell period includes a delay corresponding with a period of time used to provide the first pulse cycle and the second pulse cycle, the delay occurring after the command signal changes from a logic high value to a logic low value.

20. The ignition circuit of claim 10, wherein the first pulse cycle includes a pulse that has a width that is less than a width of a pulse of the second pulse cycle.

* * * * *